US005253576A

United States Patent [19]

Bethke

[11] Patent Number: 5,253,576

[45] Date of Patent: Oct. 19, 1993

[54] SWASHPLATE ASSEMBLY FOR AN AXIAL PISTON PUMP

[76] Inventor: Donald G. Bethke, 3619 Nagawicka Shores Dr., Hartland, Wis. 53029

[21] Appl. No.: 995,926

[22] Filed: Dec. 21, 1992

Related U.S. Application Data

[63] Continuation of Ser. No. 832,374, Feb. 7, 1992, abandoned.

[51] Int. Cl.[5] ..... F01B 3/00; F01B 13/04

[52] U.S. Cl. ..... 92/12.2; 92/71; 92/57; 91/505; 417/269; 60/487; 74/60; 29/888

[58] Field of Search ..... 92/12.2, 71, 57; 91/495, 504, 505; 417/218, 269; 29/888, 888.02, 888.025, 434; 74/60; 60/487, 489, 444

[56] References Cited

U.S. PATENT DOCUMENTS

| | | | |
|---|---|---|---|
| 2,917,931 | 12/1959 | Sherman | 92/12.2 |
| 3,175,510 | 3/1965 | D'Amato | 91/505 |
| 3,535,984 | 10/1970 | Anderson | 91/506 |
| 3,682,044 | 8/1972 | Ankeny et al. | 91/487 |
| 3,682,047 | 8/1972 | Anderson | 91/505 |
| 4,026,195 | 5/1977 | Forster | 92/12.2 |
| 4,825,753 | 5/1989 | Inoue et al. | 92/12.2 |
| 4,896,583 | 1/1990 | Lemke | 91/505 |
| 5,095,807 | 3/1992 | Wagenseil | 74/60 X |
| 5,101,555 | 4/1992 | Hauser | 29/888.02 |
| 5,184,536 | 2/1993 | Arai | 91/505 |

FOREIGN PATENT DOCUMENTS

| | | | |
|---|---|---|---|
| 574612 | 4/1933 | Fed. Rep. of Germany | 92/57 |
| 29990 | 8/1956 | Fed. Rep. of Germany | 91/505 |
| 2801952 | 7/1979 | Fed. Rep. of Germany | 91/505 |
| 147226 | 5/1931 | Switzerland | 92/12.2 |
| 841509 | 7/1960 | United Kingdom | 417/218 |

*Primary Examiner*—Edward K. Look
*Assistant Examiner*—Hoang Nguyen
*Attorney, Agent, or Firm*—Andrus, Sceales, Starke & Sawall

[57] ABSTRACT

A radial piston pump includes a pair of inboard trunions which provide tilting bearing support for the swashplate. The trunion blocks may be made from sections of ordinary cold rolled steel bar stock and attached to the end wall of the pump housing with externally accessible bolted connections which allow final precise alignment of the trunion blocks in the assembled pump. The swashplate includes a concave cylindrical bearing surface which rides on the trunion blocks and, to enable precision finishing and machining of the concave bearing surface in a simple manner. Two swashplates are made from a single metal casting in which a full cylindrical through bore can be accurately cut and finished, and the casting subsequently cut in two to provide two swashplates. The swashplate is mounted with its transverse tilt axis offset from the axis of the pump drive shaft in a direction providing a net imbalance in piston spring biasing force to urge the swashplate on-stroke to enhance start-up operation.

8 Claims, 2 Drawing Sheets

SWASHPLATE ASSEMBLY FOR AN AXIAL PISTON PUMP

This is a continuation of application Ser. No. 07/832,374, filed Feb. 7, 1992, now abandoned.

BACKGROUND OF THE INVENTION

The present invention pertains to an axial piston fluid pump and, more particularly, to a pump having an improved swashplate assembly which substantially simplifies the manufacture and assembly of the pump and provides improved operation and load distribution.

Axial piston pumps are old and well known in the art. All such pumps include a swashplate or tilt plate against which the axial piston ends bear and around which such ends rotate with the angled surface of the swashplate allowing a cyclic reciprocal movement of the pistons providing each cylinder with low pressure intake and high pressure discharge of hydraulic fluid on each rotation. The swashplate or tilt plate is journaled for rotation on a tilt axis transverse to the common axis of the drive shaft the cylindrical rotor housing the pistons. Two typical constructions are utilized in the prior art to support and journal the swashplate for tilting movement.

In one prior art construction the swashplate includes a pair of axially aligned trunions extending from opposite sides of the plate, which trunions are journaled for rotation in the cylindrical sidewall of the pump housing. This construction requires relatively large access ports in the housing sidewall to hold the trunion support bearings and to facilitate assembly. A typical construction of an axial piston pump having a swashplate with integral outboard trunions is shown in U.S. Pat. No. 3,175,510.

The other common pump construction utilizes a cradled swashplate in which a relatively large diameter concave bearing surface is attached to the inside of the pump housing end wall and cradles therein a swashplate having a pair of convex bearing surfaces on opposite sides of the pump drive shaft, which surfaces are rotatably supported in the concave bearing cradle for rocking movement. The large diameter bearing surfaces are difficult and costly to machine accurately. The assembly is also generally complex and includes a relatively large number of machined parts. Such a construction is shown, for example, in U.S. Pat. No. 3,682,044.

SUMMARY OF THE INVENTION

In accordance with the present invention, a swashplate construction for an axial piston pump includes a pair of inboard trunions providing bearing support for the swashplate, and a swashplate with a complimentary concave bearing surface rotatably supported on the trunions to provide tilting movement of the swashplate. Both the inboard trunions and the swashplate can be manufactured with stock materials and relatively simple machining techniques to provide accurate bearing surfaces. The entire pump is easily assembled through one end of the housing and final alignment of the trunions with respect to the swashplate bearing surface can be made as the final pump assembly step.

The inboard trunions may be formed from short sections of ordinary cold rolled bar stock which are machined to provide an axially extending flat by which each trunion is mounted against the inside surface of the pump housing end wall. The trunions are mounted with bolts extending through the end wall and, in the assembly of the pump, are initially left somewhat loosely mounted. The bolts are drawn tight after the remainder of the pump has been assembled whereby the swashplate and rotor assembly will cause the trunions to align for final tightening of the mounting bolts.

The trunion blocks are preferably positioned to place the swashplate tilt axis offset radially from the drive shaft axis. The offset direction is selected to create an inherent biasing of the swashplate to tilt it in the on-stroke direction, thereby eliminating the need for a sophisticated starting system.

The swashplate is preferably formed from a metal casting which is eventually cut in two to provide two swashplates. The casting includes a pair of opposite generally planar parallel surfaces which ultimately comprise the reaction surfaces of the two swashplates. A cylindrical bore is cut and finished through the casting midway between and parallel to the opposite planar surfaces. The casting is then cut into two substantially identical pieces on a cutting plane parallel to the planar surfaces and on the axis of the cylindrical bore, resulting in two identical swashplates.

DETAILED DESCRIPTION OF THE PREFERRED EMBODIMENT

Figure 1:
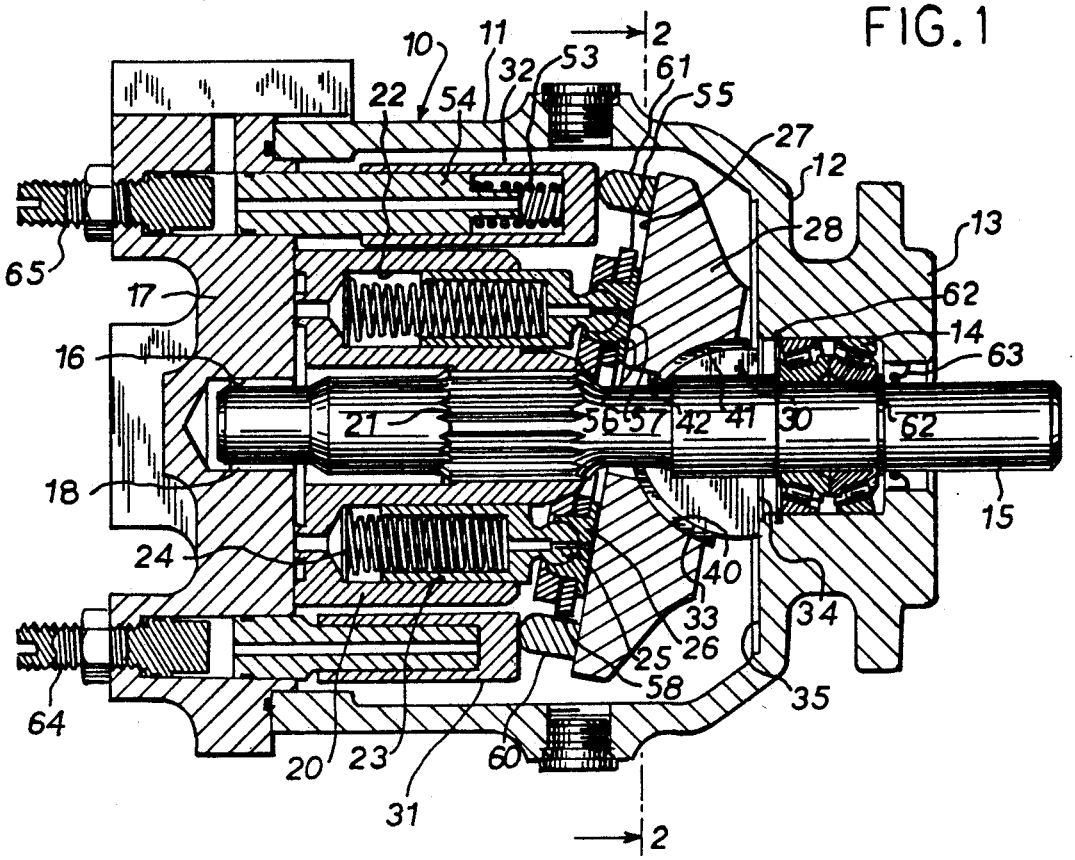
FIG. 1 is a vertical section through an assembled axial piston pump including the swashplate assembly of the present invention.

An axial piston pump including the swashplate of the present invention includes a housing 10 made from a casting and including a generally cylindrical outer wall 11 and an integral end wall 12. The end wall 12 includes an axially disposed hub 13 which is bored to receive a pair of tapered roller bearings 14 to rotatably support one end of a drive shaft 15. The end of the drive shaft extending outside the housing end wall 12 is typically provided with a pulley, coupling, or direct drive for receiving a drive belt or drive shaft from a suitable source of motive power, such as an electric motor. The other end of the drive shaft is rotatably supported in a counterbore 16 in the cover plate 17. A suitable journal bearing 18 is disposed between the counterbore and the drive shaft end.

A rotor assembly including a generally cylindrical rotor 20 is mounted for rotation on the drive shaft 15 by a suitable splined connection 21. The rotor includes a plurality of circumferentially spaced, axially extending cylinders 22 surrounding and parallel to the drive shaft. An axially reciprocable piston 23 is disposed in each cylinder. Each piston is counterbored to receive one end of a compression spring 24, the opposite end of which is bottomed in the cylinder 22. The compression springs 24 together provide a biasing force urging the pistons 23 to extend out of their respective cylinders 22.

The individual piston springs 24 could be eliminated and replaced with a single central spring which biases the entire rotor assembly and provides the necessary holddown. The outer ends of the pistons 23 are provided with balls 25 which are received for universal pivotal movement in shoes 26. Each of the shoes 26 has a flat surface opposite the piston end which slidably engages a smooth flat reaction surface 27 on the swashplate 28.

The swashplate 28, in turn, is supported for tilting movement about an axis transverse to the axis of the drive shaft 15 on a pair of cylindrical trunion blocks 30 mounted on the inside surface of the outer housing wall 11. The reaction surface 27 of the swashplate may be variably tilted between a zero or no-stroke position in which the surface 27 is perpendicular to the axis of the drive shaft 15 and a maximum full-stroke position in which the reaction surface 27 is tilted, for example 5° to 20°, from its zero perpendicular position. The tilt position of the swashplate 28 is variably controlled by various combinations of reaction forces, including the piston compression springs 24, a volume control off-stroking piston 31 and a pressure compensating on-stroking piston 32. These elements will be discussed in greater detail below.

The basic operation of the pump may be briefly summarized as follows. As the drive shaft 15 is turned, as by an electric drive motor, the rotor 20 will turn with the drive shaft because of its splined connection 21 thereto. The cover plate 17 includes an inlet from a low pressure source of hydraulic fluid and an outlet from the pump for pressurized fluid, neither of which is shown in the drawing. As the shaft and rotor turn, the pistons 23 which rotate around the side of the pump served by the fluid inlet move axially outwardly against the reaction surface 27 of the swashplate 28 under the urging of the bias springs 24, thereby drawing fluid into the cylinders 22, such as the upper cylinder shown in FIG. 1. As the pistons continue to rotate toward the outlet side of the pump, the pistons 23 are cammed inwardly as a result of their sliding movement along the inclined reaction surface 27, thereby forcing hydraulic fluid under pressure from the cylinders 22. The volume of fluid drawn into the cylinders and subsequently pumped under pressure therefrom depends on the angle at which swashplate 28 is disposed. With maximum flow, as indicated above, the swashplate 28 is tilted to its maximum position. The foregoing description is generally common to the operation of all axial piston pumps.

In accordance with the present invention, the swashplate 28 and supporting trunion blocks 30 are made in a manner that provides simple, relatively low cost and accurate machining, simplifies assembly of the pump, and allows simple and effective final adjustment of the swashplate bearing surfaces to assure accurate alignment. Furthermore, the inboard mounting of the trunion blocks 30 provides direct support to the rear face of the swashplate in direct alignment with the rotational circle of the pistons 23.

Figure 2:
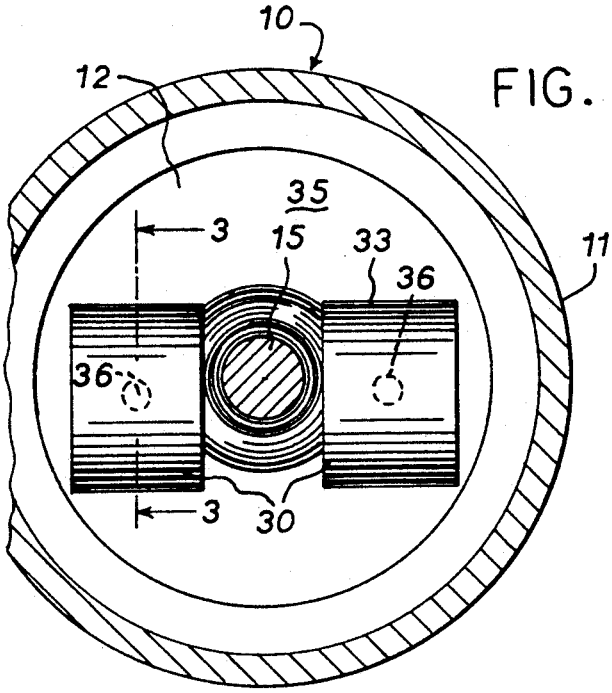
FIG. 2 is a simplified sectional view taken generally on line 2—2 of FIG. 1 showing the positioning and mounting of the inboard trunion blocks.
Figure 3:
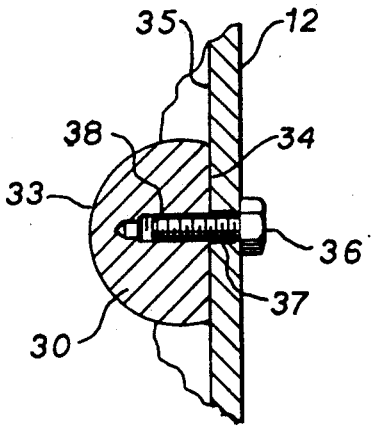
FIG. 3 is a section taken on line 3—3 of FIG. 2.

Referring also to FIGS. 2 and 3, the trunion blocks 30 are made from short sections of cold rolled steel bar. Each trunion block 30 has a semicylindrical outer surface 33 which is truncated by a milled flat 34 formed thereon. The trunion blocks are adapted to be mounted with the milled flats 34 against the flat inner surface 35 of the end wall 12. Each trunion block 30 is held in position by a mounting bolt 36 extending through a mounting hole 37 in the end wall and into a suitably tapped hole 38 in the trunion block perpendicular to the milled flat 34. The mounting hole 37 is made slightly oversize with respect to the diameter of the mounting bolt 37 to allow some slight adjustment of the position of the trunion block, as will be described in greater detail with the description of the assembly of the pump. The trunion blocks 30 are mounted on opposite sides of the drive shaft 15 with the common axis of rotation, defined by the semicylindrical surfaces 33, offset slightly from the axis of the drive shaft, as may be seen in FIGS. 1 and 2.

The swashplate 28 is provided on the side opposite the reaction surface 27 with a concave cylindrical bearing surface 40 having a diameter just slightly larger than the diameter of the semicylindrical surfaces 33 of the trunion blocks 30. The swashplate bearing surface 40 bears on and is supported by the surfaces 33 of the trunion blocks, preferably with a suitable solid low friction sleeve bearing 41 interposed therebetween. The concave bearing surface 40 is interrupted by a centrally disposed through hole 42 for passage of the drive shaft 15. The through hole 42 must be large enough to accommodate the full tilt angle of the swashplate in operation and to also allow passage of the largest diameter portion of the drive shaft (i.e. the splined portion 21) during assembly.

Figure 4:
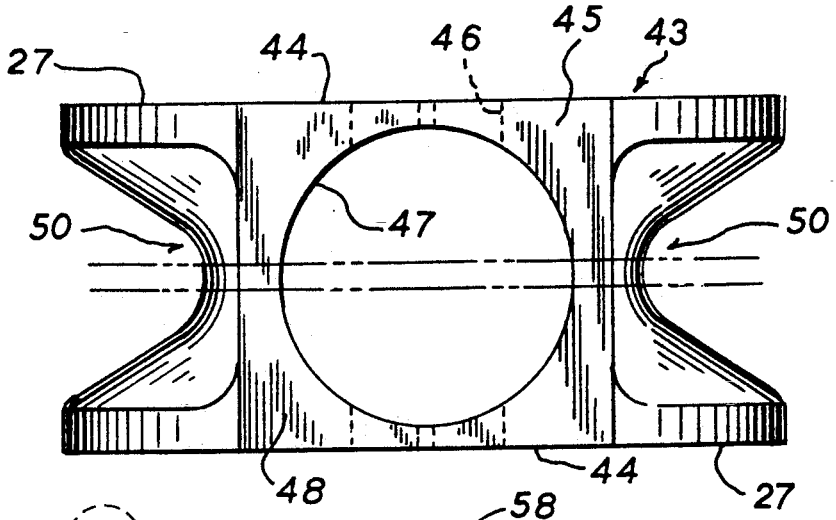
FIG. 4 is a side elevation of the special machined casting from which two swashplates of the present invention are made.
Figure 5:
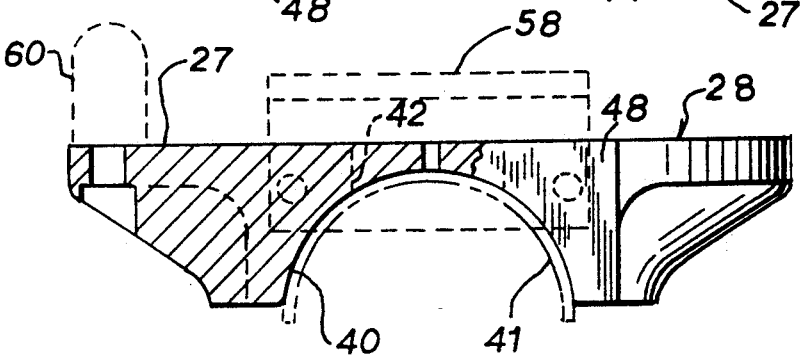
FIG. 5 is an elevation, partly in section, showing one swashplate made from the casting shown in FIG. 4.
Figure 6:
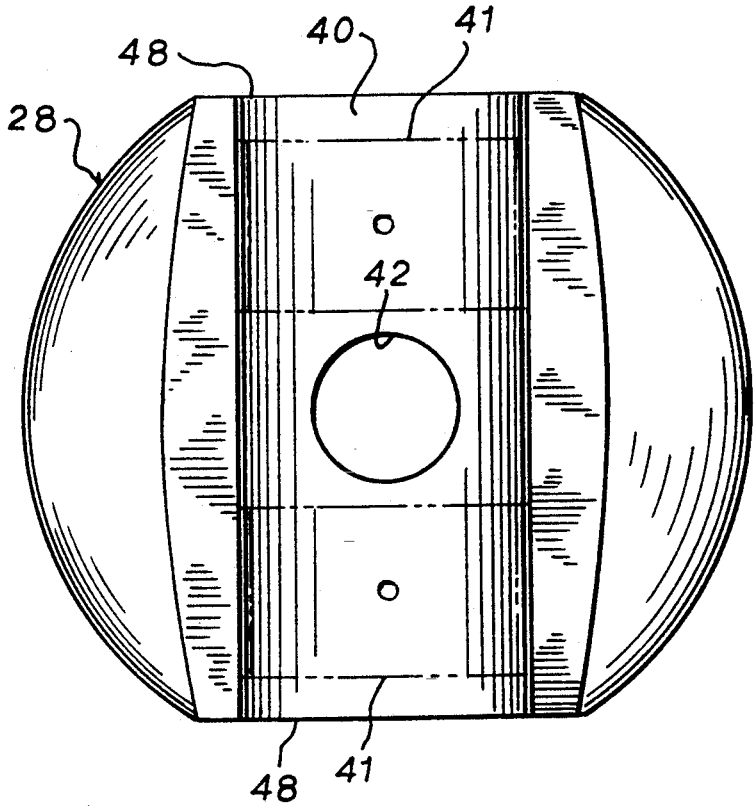
FIG. 6 is a plan view of the bearing face of the swashplate shown in FIG. 5.

Referring also to FIGS. 4–6, the machining of a semicylindrical surface, such as bearing surface 40 in the swashplate, is known to be a difficult task and accuracy of the final machined surface is hard to maintain. In accordance with one aspect of the present invention, the swashplate 28 is made from a casting 43, as shown in FIG. 4, which is eventually cut in two to form two separate swashplates. The casting 43 includes opposite generally planar parallel surfaces 44 which are eventually ground and finished to form the reaction surfaces 27 on the two swashplates. The casting may be made of ductile iron and includes a generally solid central portion 45 in which mutually perpendicular small and large cross bores 46 and 47, respectively, are formed. Preferably, the cross bores 46 and 47 are rough-formed in the casting itself to reduce subsequent machining effort. The casting includes opposite flat end faces 48 on opposite ends of the large cross bore 47 and the opposite lateral sides are necked-down by the formation of recesses 50 to reduce weight and provide necessary clearances in the finished swashplate. The large cross bore 47 in the casting 43 may be accurately formed, as by suitable drilling and/or reaming techniques to provide an accurate and truly cylindrical surface. The small cross bore 46 which intersects the large cross bore may be suitably machined, but because it is only a clearance hole, precision finishing is not necessary. When the large cross bore 47 has been machined to a suitable cylindrical shape and desired finish, the casting is cut into two substantially identical pieces on a cutting plane parallel to the planar surfaces 44 and through the axis of the large bore 47. Loss of material in the cutting operation is not particularly significant and may include as much as is included between horizontal parallel broken lines shown in FIG. 4. The cut faces do not require a precision finishing operation and the result is a pair of identical swashplates, one of which is shown in FIGS. 5 and 6. The concave semicylindrical bearing surface 40 in the finished swashplate 28 may circumscribe and arc slightly less than 180° because of material lost in cutting the casting. The solid low friction sleeve 41 which is preferably mounted in the bearing surface 40 of the swashplate may have an outer surface coated or impregnated with PTFE to provide a low friction surface to bear against the trunion blocks 31 thereby requiring no additional lubrication.

Volume control in the pump is provided internally by the volume control piston 31, also referred to as an off-stroking piston because of its tendency to bias the swashplate 28 toward the no flow position, and the opposite pressure compensating piston 32 which is also referred to as an on-stroking piston and which is biased to tilt the swashplate 28 toward the full or maximum flow position. The off-stroking piston 31 receives high pressure fluid from the pump outlet port through suitable porting (not shown) and the on-stroking piston 32 is similarly provided with pressurized fluid from the pump outlet port through porting (also not shown). However, the area on which high pressure fluid acts in the on-stroking piston 32 is greater (e.g. 2 times) that of the off-stroking piston 31, thereby normally forcing the swashplate 28 toward the maximum full-flow position. Pressure control may be provided externally of the pump with relief valve apparatus (not shown). The on-stroking piston 32 also includes an internal bias spring 53 extending between an adjustable piston stem 54 and the end of the piston 32 to also provide an inherent biasing force against the swashplate in the on-stroke direction. The bias spring is particularly useful when the swashplate angle is small or when the pump is started and full pressure has not been attained to keep the swashplate biased on-stroke. As previously indicated, the trunion blocks 30 are positioned offset somewhat from the axis of the drive shaft 15 and, in FIG. 1, the offset is downward such that the tilt axis of the swashplate is below the drive shaft axis. The result is an imbalance in the net force exerted by the compression springs 24 in the pump pistons 23 which also tends to bias the swashplate on-stroke. The combination of the bias spring 53 in the on-stroking piston 32 and the net offset reaction force of the piston springs 24 provides a very simple pump start-up system which is far less complex than those typical of the prior art.

The piston shoes 26 which must slide in a circular movement around the reaction surface 26 of the swashplate are held in position by a retainer plate 55 provided with a number of holes equal to the number of pistons (e.g. 7) which surround the shoes 26 such that the peripheral edges of the retainer plate defining the holes bear on flanges 57 on the shoe faces in engagement with the reaction surface 27. The retainer plate rotates with the rotor/piston assembly and is held by slidable engagement with a pair of oppositely disposed holddown brackets 58 which are of L-shaped construction and are bolted to the opposite end faces 48 of the swashplate. One holddown bracket 58 is shown in phantom in FIG. 5. The ends of the off-stroking and on-stroking pistons 31 and 32, respectively, bear against respective cylindrical bearing members 60 and 61 which are bolted or otherwise attached to the reaction surface 27 of the swashplate. The control pistons 31 and 32 are fixed in the pump housing 10 and the cylindrical bearing members 60 and 61 provide full line contact with the piston ends and yet accommodate the small amount of sliding movement occasioned by tilting of the swashplate.

The assembly of the pump of the present invention is simple and straightforward, may be accomplished virtually entirely through the open end of the housing 10, requires no access to the interior of the housing from the sides or opposite end, and results in precision alignment of the swashplate 28 on the trunion blocks 30. The roller bearings 14 are initially inserted into the hub 13 of the open housing 10 and secured therein with suitable snap rings 62 or the like. Before or after installation of the roller bearings 14, the trunion blocks 30 are loosely attached to the flat inner surface 35 of the housing end wall 12, by threading the mounting bolts 36 into the trunion blocks through the mounting holes 37 in the end wall. The mounting bolts 36 are snugged to preliminarily align the trunion blocks with their axes commonly aligned, but the bolts are not tightened so that some adjustment movement of the blocks is possible. The entire subassembly comprising the rotor 20, springs 24, pistons 23 with attached shoes 26, and swashplate 28, including retainer plate 55, holddown brackets 58 and bearing members 60 is assembled, held together against the bias of the springs 24, and inserted into the open housing 10 with the drive shaft 15 extending through the hole 42 in the swashplate and the central bore in the rotor. The cover plate 17 is then placed over the open end of the housing with the opposite end of the drive shaft 15 received in the counterbore 16 in the center of the cover plate. When the subassembly including the swashplate 28 is inserted into the housing, the concave bearing surface 40, suitably lined with the sleeve bearing 41, overlies the semicylindrical surfaces 33 of the trunion blocks 30 and brings them into final exact coaxial alignment. After the cover plate 17 has been bolted down, the trunion block mounting bolts 36 are tightened from the outside of the end wall 12 to complete the assembly. A suitable shaft seal 63 may be inserted from the outside into the recess in the hub 13 surrounding the end of the drive shaft 15. It should be noted that the on-stroking and off-stroking pistons 32 and 31 are attached to the inside face of the cover plate 17 before it is placed over the housing to finally close the same. Each of the pistons 31 and 32 is held initially in the cover plate by a threaded adjustment screw 64 and 65, respectively, on their ends.

Various modes of carrying out the present invention are contemplated as being within the scope of the following claims particularly pointing out and distinctly claiming the subject matter which is regarded as the invention.

I claim:

1. In an axial piston pump assembly which includes a housing having an outer wall defining a generally cylindrical interior and an end wall, a drive shaft extending through the end wall and rotatably mounted in the housing for rotation on the axis of the cylindrical interior, a rotor attached to the drive shaft for rotation therewith, a plurality of circumferentially spaced axially disposed cylinders in the rotor, axially reciprocable pistons disposed in the cylinders, a swashplate surrounding the drive shaft and mounted in the housing for tilting movement on a tilt axis transverse to the drive shaft axis, a planar reaction surface on the swashplate which is engaged by the outer ends of the pistons, biasing means for urging the piston ends into engagement with the reaction surface, and control means for tilting the swashplate on its axis to maintain the reaction surface angularly disposed with respect to the axis of the drive shaft; an improved swashplate mounting assembly comprising:

a pair of inboard trunion blocks individually and adjustably attached to the interior of the housing end wall on opposite sides of the driveshaft;

means for attachment said trunion blocks to the end wall for movement between an adjustable preliminary assembly position and a fixed final assembly position;

each of said trunion blocks having a convex semicylindrical outer surface, said outer surfaces having coincident axes which define the tilt axis of the swashplate; and, concave semicylindrical bearing surfaces on the side of the swashplate opposite said reaction surface supporting the swashplate for tilting movement on said trunion block outer surfaces.

2. The pump assembly as set forth in claim 1 comprising a mounting surface on the interior of the end wall having a generally flat surface extending perpendicular to the axis of the drive shaft; and, the trunion blocks each include an axially extending flat face abutting said mounting surface.

3. The pump assembly as set forth in claim 2 wherein said attaching means comprises a threaded mounting bolt for each trunion block, each bolt extending through the housing end wall and into engagement with the trunion block to draw the flat face tightly against the flat mounting surface.

4. The pump assembly as set forth in claim 1 wherein said trunion blocks are positioned to place the swashplate tilt axis offset from the drive shaft.

5. The pump assembly as set forth in claim 4, wherein the tilt axis is offset in a direction causing the biasing means to tilt the swashplate on-stroke.

6. The pump assembly as set forth in claim 1 wherein the concave bearing surfaces comprise low friction cylindrical sleeve bearings.

7. A method of manufacturing a swashplate for an axial piston pump, which swash plate includes a plate body having a smooth planar surface on one side and a concave semicylindrical bearing surface on the other side, the axis of the bearing surface lying parallel to the planar surface, the method comprising the steps of:

a) forming a metal casting with opposite generally planar parallel surfaces;

b) cutting and finishing a cylindrical bore through the casting midway between and parallel to said generally planar surfaces; and, c) cutting the casting into two substantially identical pieces on a cutting plane parallel to said planar surfaces and on the axis of said cylindrical bore, whereby each piece comprises a swashplate.

8. A method of assembling an axial piston pump comprising the steps of:

a) providing a pump housing having an outer wall defining a generally cylindrical interior, a closed end wall with a drive shaft opening therein disposed on the axis of the housing, and an opposite open end;

b) loosely attaching, with tightenable fasteners accessible from outside the housing, a pair of trunion blocks to the interior of the end wall on opposite sides of the opening, said blocks having alignable convex semicylindrical outer surfaces to provide a common axis extending transverse to the housing axis;

c) rotatably mounting a drive shaft on the axis of the housing with one end of the shaft journaled in the drive shaft opening;

d) providing a swashplate having a concave semicylindrical bearing surface on one side, said bearing surface having a radius slightly greater than the radius of said convex outer surfaces, a smooth planar reaction surface on the opposite side of the swashplate parallel to the axis of the bearing surface, and a drive shaft hole in the center of the swashplate extending through the bearing surface and the reaction surface;

e) providing a piston subassembly including a rotor housing having a central drive shaft-engaging bore and a plurality of circumferentially spaced axially disposed cylinders surrounding said bore, axially reciprocable pistons disposed in the cylinders and having piston ends extending outwardly from the cylinders in the same direction, and biasing means for urging the pistons axially in said same direction;

f) inserting the swashplate and piston subassembly into the housing through the open end, around the drive shaft, with the swashplate bearing surface against the convex outer surfaces of the trunion blocks to allow the swashplate to tilt thereon such that the axis of said concave bearing surface provides a tilt axis coincident with the common axis of said outer surfaces, the drive shaft received in and extending through said rotor bore in driving engagement therein and with the piston ends in biased slidable rotational engagement with the reaction surface;

g) closing the open end of the housing with a cover plate, said plate having centrally disposed bearing means for rotatably supporting the other end of the drive shaft and means for engaging the rotor assembly and holding the biased engagement between the piston ends and the swashplate reaction surface; and, h) tightening said fasteners to secure said trunion blocks to the housing end wall and to maintain alignment of the convex outer surfaces on said common axis.

* * * * *

UNITED STATES PATENT AND TRADEMARK OFFICE

CERTIFICATE OF CORRECTION

PATENT NO. : 5,253,576

DATED : Oct. 19, 1993

INVENTOR(S) : Donald G. Bethke

It is certified that error appears in the above-indentified patent and that said Letters Patent is hereby corrected as shown below:

Claim 1, column 7, line 1, delete "attachment" and substitute therefor --attaching--.

Signed and Sealed this

Fifth Day of April, 1994

Bruce Lehman

*Attest:*

BRUCE LEHMAN

*Attesting Officer*

*Commissioner of Patents and Trademarks*